United States Patent [19]

Spangler

[11] 4,043,032

[45] Aug. 23, 1977

[54] TERMINAL APPLICATOR APPARATUS FOR TERMINALS IN STRIP FORM

[75] Inventor: Paul Joseph Spangler, Novelty, Ohio

[73] Assignee: International Telephone and Telegraph Corporation, New York, N.Y.

[21] Appl. No.: 685,794

[22] Filed: May 12, 1976

[51] Int. Cl.[2] ..... H01R 43/04; B21F 15/00

[52] U.S. Cl. ..... 29/628; 29/630 A; 29/33 M; 29/748; 29/753; 140/1

[58] Field of Search ..... 29/628, 630 R, 630 A, 29/203 D, 203 DT, 203 DS, 203 P, 33 K, 33 M, 748, 753, 759, 761; 140/1

[56] References Cited

U.S. PATENT DOCUMENTS

| | | | |
|---|---|---|---|
| 3,423,815 | 1/1969 | Spangler et al. | 29/203 DS |
| 3,553,814 | 1/1971 | Rider | 29/203 DS |
| 3,653,412 | 4/1972 | Gudmestad | 140/1 |
| 3,857,154 | 12/1974 | Hammond et al. | 29/203 P |
| 3,968,548 | 7/1976 | Clark et al. | 29/33 M |

*Primary Examiner*—Victor A. DiPalma
*Attorney, Agent, or Firm*—James B. Raden; William J. Michals

[57] ABSTRACT

A terminal applicator for applying terminals in the form of a continuous belt and having a crimping die and a crimping anvil movable relatively towards and away from each other is disclosed. The belt of terminals is fed along a feed path extending behind the dies to present and index the leading terminal on the belt to the dies. After crimping, the dies move relatively away from each other to free the crimped terminal. An ejector means is spaced laterally of the feed path and moves into engagement with the wire and away from the dies, while the other end of the wire is held by a wire clamp, so that the crimped terminal is broken away from, and thereby removed from, the belt. In one embodiment, the wire clamp is movably mounted for lateral movement toward and away from the dies, so that the wire end may be inserted into a closed-barrel terminal prior to the crimping operation.

11 Claims, 4 Drawing Figures

TERMINAL APPLICATOR APPARATUS FOR TERMINALS IN STRIP FORM

BACKGROUND OF THE INVENTION

This invention relates to terminal applicator apparatus wherein terminals provided on a continuous belt are indexed toward the crimping dies; and, more particularly, to such apparatus wherein the crimped wire end is moved away from the belt and the crimping dies so that the terminal is broken away from and removed from the belt.

It is known in the art to provide several types of crimpable connecting devices such as terminals on a continuous belt of plastic or thin metal. The terminals are suitably secured to the belt in a manner such that they can be fed to a crimping apparatus and the leading terminal of the belt is crimped onto a wire after which it is removed from the belt. Apparatus wherein the crimped termination is separated from the belt after crimping, and in a positive manner without the need of any particular manipulative steps on the part of the operator are also known and have been widely used in the art. A device of this type is exemplified in the U.S. Pat. No. 3,553,814. These devices utilize a belt moving means for moving the belt guiding means relatively away from the crimping dies while the dies are in their closed condition and in engagement with a crimped terminal thereon, thereby to break the crimped terminal away from the belt.

These prior art devices essentially provide a moving table adapted for lateral movement away from the dies and wherein the belt indexing mechanism is fixedly disposed onto the movable table. The table is connected to the ram of the associated press by means of a linkage system wherein the movable table is moved during a predetermined portion of the operating cycle of the press ram. These devices suffer with the obvious disadvantage that such a movable table arrangement is inordinately complex as well as expensive. Further, these devices are necessarily provided with some form of ejection means to physically remove the terminated wire lead from the vicinity of the crimping dies and after the moving table has functioned to break the terminal away from the belt.

These and other disadvantages are overcome by the present invention wherein the feeding or belt indexing means are advantageously fixedly mounted relative to the crimping dies or crimping station. The terminated lead is broken away from the belt by means of a dual-purpose ejector means which not only serves to remove the terminated lead from the vicinity of the crimping dies but also functions to break the terminated lead from the continuous belt.

SUMMARY OF THE INVENTION

Briefly, apparatus for crimping electrical terminal devices onto wires and of the type being secured to a belt and side-by-side relationship with their axes extending laterally of the belt, is provided. The apparatus includes a pair of cooperable crimping dies with the dies being movable relatively towards and away from each other to crimp a terminal device located therebetween onto one end of a wire. Belt feeding means including belt guiding means on one side of the dies are provided. The belt feeding means is effective to guide and index the belt along a path extending past the dies on the one side thereof, thereby to locate the leading terminal on the belt between the dies. First means located on the other side of the dies are provided for holding the wire in substantially fixed relationship and at a point thereof which is spaced apart from the one end of the wire. Means are also located between the first means and the dies, for moving the wire adjacent the one end of the wire, and relatively away from the dies prior to or during a subsequent indexing of the belt. Accordingly, the apparatus functions to break the crimp terminal away from the belt.

BRIEF DESCRIPTION OF THE DRAWINGS

The advantages of this invention will become more readily appreciated as the same becomes completely understood by reference to the following detailed description when taken in conjunction with the accompanying drawing wherein.

DETAILED DESCRIPTION

Figure 1:
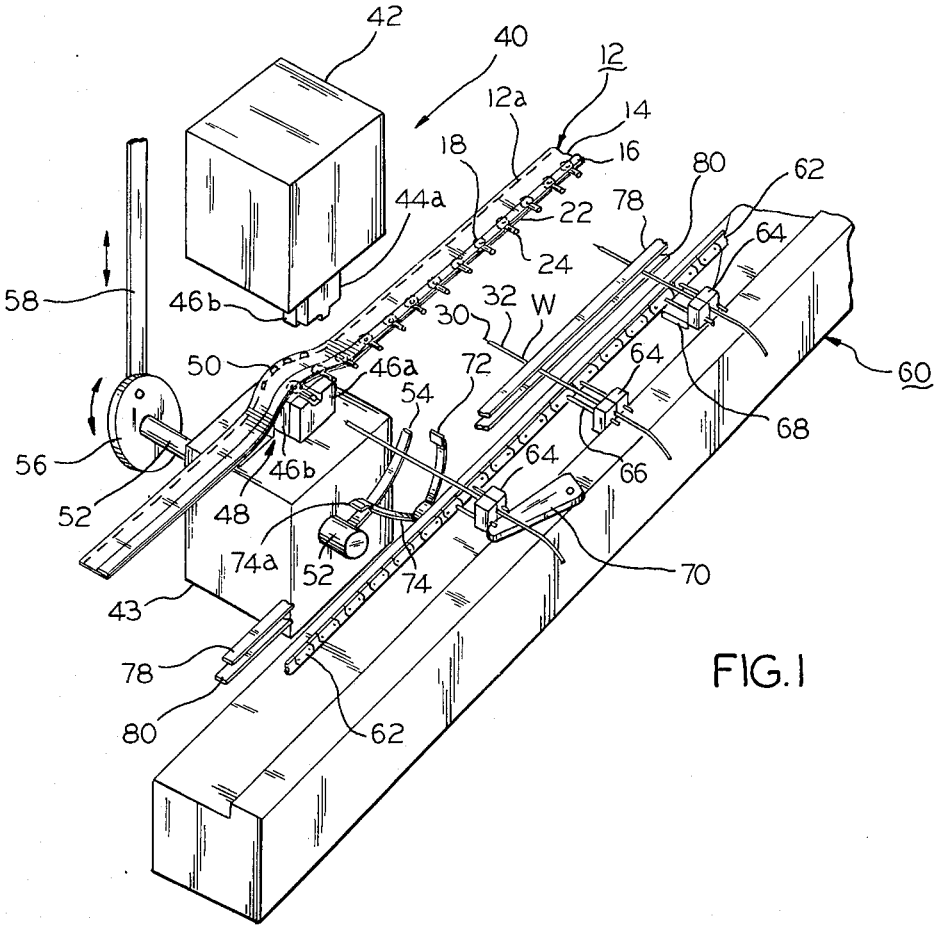
FIG. 1 is a perspective view of a terminal applicator apparatus, in accordance with the present invention, showing the relationship of a continuous belt of terminals, a wire clamping device and an ejector means.

Referring now to FIG. 1, there is shown a perspective view of a terminal applicator device 10 in accordance with the present invention. Device 10 is shown in conjunction with a typical form of terminal belt 12. Belt 12 comprises a relatively wide strip 14 of suitable plastic such as Mylar and a relatively narrow strip 16 of the same material which extends along one edge of the wide strip. The ring tongue portions 18 of the terminals are held against the surface of the wide plastic strip 14 by means of the narrow strip 16 which is bonded as by welding at discrete locations surrounding the terminal. The neck portions 22 of the terminals extend laterally beyond the wide plastic strip 14 and merge with the barrel portions 24 of the terminals. The wide strip 14 of plastic has spaced-apart perforations **12*a* along one side thereof which are adapted to be engaged by suitable teeth of the feeding or indexing mechanism when the strip or belt is placed in applicator device 10. The barrel portions of the terminals are adapted to be crimped onto the striped end 30 and the insulation 32 of leads or wires W during a crimping operation as belt 12 and wires W are fed toward the crimping station of the applicator 10**. It will be understood that a wide variety of types of terminal devices, including splices, are commercially available in belt form as generally illustrated. Thus, the term "terminals" is used as a matter of convience and is intended to include all types of connecting terminals or devices.

Referring again to FIG. 1, it can be seen that terminal applicator device 10 includes a press 40 which may be an air press, an electric press, or any other suitable reciprocating press. However, a preferred press is one which includes means to advance the movable die into engagement with the ferrule which is about to be crimped, as taught and claimed in the U.S. Pat. to P. J. Spangler No. 3,423,815 — which patent is assigned to the same assignee as the present invention.

Press 40 includes a housing (not shown) having disposed therein a ram 42 having an insulation crimping die 44*a* and an electrical conductor crimping die 44*b* disposed on a lower surface thereof. A set of lower or anvil dies 46*a* and 46*b* are disposed upon a stationary die base 43 of press 40. Dies 46*a* and 46*b* cooperate with crimping dies 44*a* and 44*b* in a well-known manner. Belt 12 is fed through press 40 from right to left with respect to FIG. 1 through a guide cage 48 having a sprocket wheel 50 rotatably disposed therein. Sprocket wheel 50 includes teeth which engage perforations 12*a* of belt 12 and functions to index tape 12 through press 40, thereby to present the leading terminal of the belt at the crimping station during each operating cycle.

Journaled within the die base member 43 of press 40 is a shaft 52 which projects outwardly from opposite surfaces thereof to accept an ejection means or flipper 54 at one end thereof and a plate 56 at the opposite end thereof. Plate 56 is pivotally connected to a linkage rod 58 which, in turn, is connected at its other end to a suitable linkage member connected to the power ram of press 40. The linkage is selected such that flipper 54 is translated counterclockwise in FIG. 1 during a predetermined portion of each operating cycle of press 40.

Terminal applicator device 10 further includes an automatic wire feeding and measuring, cutting and stripping machine such as the machine manufactured by the Artos Engineering Company as their model number CS6-CTU. This wire handling machine 60 includes wire measuring cutting and stripping apparatus (not shown) which is controlled by a conventional control unit (also not shown). The precut lengths of wire W are conveyed to the crimping station by means of a conveyor including a chain 62 having separable wire clamp members 64 carried thereon. That is, after a predetermined length of wire W has been cut and the insulation removed from at least one of its ends, the wire W which is received within separable clamp 64 is conveyed toward the crimping station by means of the moving chain 62.

Clamps 64 are slidably mounted on rods 66 to facilitate an insertion operation in accordance with a feature of the present invention. That is, clamps 64 are translated outwardly by means of a cam surface 68 in preparation for the subsequent insertion operation. After the clamp 64 enters the crimping zone, it is translated back toward the dies by means of a second flipper member 70, the sequence of which is also under the control of the central control unit (not shown). Unit 60 further includes a movable, V-shaped, horizontal plane, wire guide comprising legs or guide members 72 and 74 which also operate under the control of the central control unit. That is, as a given length of wire W is advanced into the crimping station, over the initially open legs or guide members 72 and 74, these members are closed into a spaced-apart vertical direction to constrain wire W to a given horizontal position. The closing operation of members 72 and 74 are synchronized with the operation of flipper 70 so that the leading end of wire W is captured between members 72 and 74 and is otherwise unobstructed by the closing operation of the vertical members. The various details of a conveyor transfer unit suitable for use with the present invention, are set forth in U.S. Pat. No. 3,653,412, to which reference may be had for a more complete description.

However, in accordance with a further feature of the present invention, one or more horizontally disposed guides 78 and 80 are additionally provides to constrain wire W in the vertical plane. Accordingly, the horizontal and vertical guide means assure that wire W is substantially coaxial with the barrel of the terminals on belt 12. Further, in one constructed embodiment, the crimping dies were additionally provided with a separable or split funnel guide respectively disposed on member 42 and lower base member 43 of press 40. This apparatus cooperates with the vertical and horizontal guide means to assure that the leads W are precisely inserted coaxially with the barrel of the terminals carried by belt 12.

Figure 2:
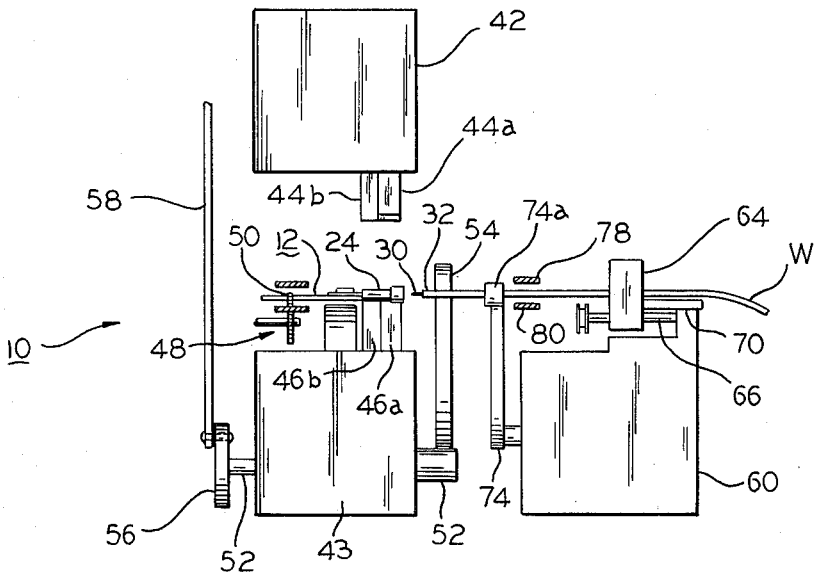
FIG. 2 is a side view of the terminal applicator apparatus of FIG. 1, which illustrates the linkage between the ejector means and the press ram in accordance with a preferred embodiment of the present invention.

Referring now to FIG. 2, there is shown a side view in partial section of the terminal applicator device 10 of FIG. 1. FIG. 2 illustrates somewhat more clearly the guides 78 and 80 which cooperates with guides 72 and 74 to locate lead W substantially coaxially with the terminal crimping barrels. Guides 72 and 74 are fixedly mounted to terminal applicator device 10 by means of horizontally disposed U-shaped brackets (not shown) so as to provide sufficient clearance for the stripped wires, or by any other suitable means.

In operation, terminal applicator device 10, in accordance with the present invention, functions as follows. The tape feeding and guiding mechanism causes sprocket wheel 50 to be angularly displaced or rotated by a predetermined amount essentially equivalent to the linear spacing between two successive terminals on belt 12, thereby to present the leading terminal between the crimping dies at the crimping station. During this time, a new lead is advanced by chain 62 in substantial coaxial alignment with the leading terminal. At this time, ram 42 is preferably pre-advanced into engagement with the leading terminal as set forth in the above-identified Spangler patent. Thereafter, flipper 70 rapidly translates wire clamp 64 toward the crimping dies and fully into the crimping station thereby inserting the leading end of wire W, which is guided by the now vertically disposed guide members 72 and 74, into the barrel of the terminal. Thereafter, the dies are closed by operation of the ram 42 to crimp the leading terminal onto the end of wire W. As the cycle continues and prior to or during the subsequent indexing operation of belt 12, linkage member 58 rotates shaft 52 to cause flipper 54 to be translated in a counterclockwise direction with respect to FIG. 1. During this operation, wire clamp 64 securely holds the lead or wire W at its remote end portion with respect to the crimping station. As flipper 54 continues to rotate, it engages lead W adjacent its terminated end. As described more fully hereinafter, flipper 54 functions to break the crimped terminal away from the belt 12. Thereafter, continued movement of flipper 54 also ejects the terminated lead from the immediate vicinity of the dies. Finally, wire clamp 64 is released at the desired end of the travel of chain 62 and the completed lead is dropped into a catcher.

Figure 3:
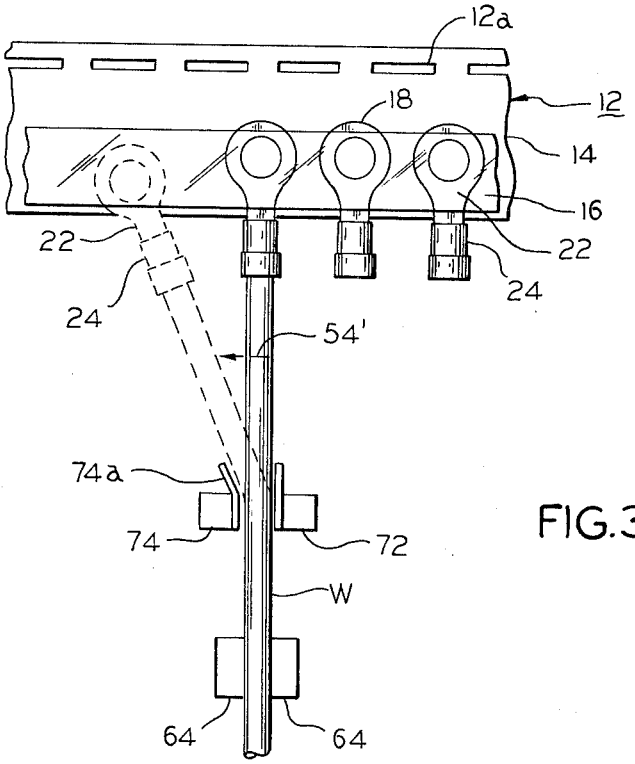
FIG. 3 is a combined pictorial and functional diagram illustrating the function of the ejector means in accordance with one embodiment of the present invention; and, FIG. 4 is a diagram similar to FIG. 3 but which illustrates an alternative embodiment in accordance with the teachings of the present invention.
Figure 4:
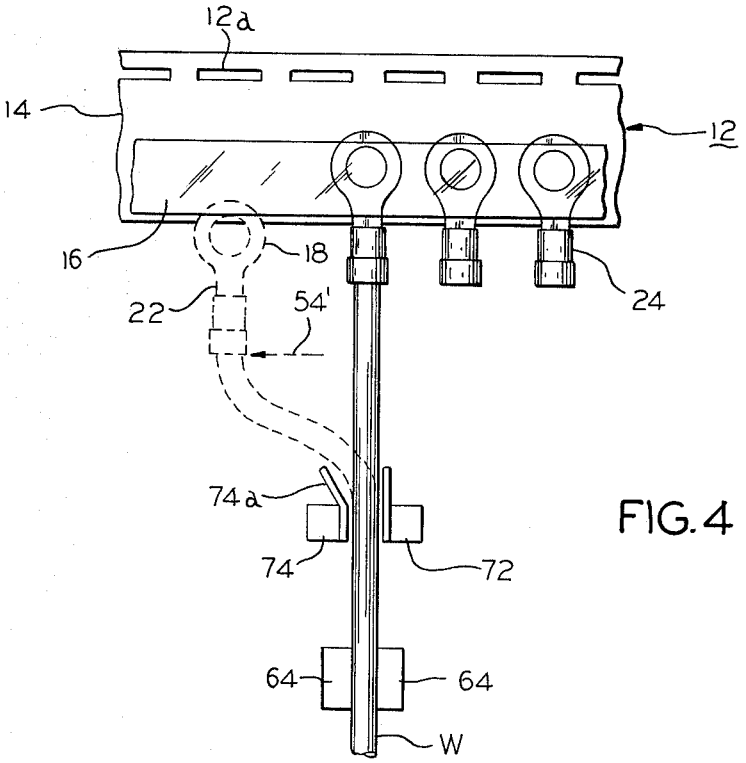

It can be seen by reference to FIGS. 3 and 4, that continued movement of flipper 54' effectively pulls the completed or terminated lead away from belt 12 and the crimping dies, and as a function of the angle between the original lead position and the hypotenuse formed by such translation. As illustrated in FIG. 3, it has been observed that continued movement of flipper 54' causes the terminal to be somewhat rotated from its normal fixed transverse position with respect to belt 12. During this time, the weld, which previously rigidly constrained the terminal to the belt, is broken and continued movement of flipper 54 frees the crimped terminal from belt 12.

As illustrated in FIGS. 3 and 4, member 74 preferably includes a contoured member 74*a* which projects away from member 74 at an angle substantially corresponding to, or coincident with, the hypotenuse formed by wire W as it is moved by flipper 54 and pulled away from belt 12. In this manner, any shearing of wire W, which might otherwise occur, is avoided.

It can be seen by reference to FIGS. 3 and 4 that the lateral position of flipper 54', with respect to the crimping dies, can be selected so as to provide a given one of a plurality of different sequences or movements of the crimped terminal with respect to belt 12. That is, by mounting flipper 54' sufficiently close to the crimping dies, the removal of the terminal from belt 12 can be accomplished along a path which is substantially perpendicular to the belt; whereas, locating flipper 54' further from the crimping dies results in a greater angular displacement of the terminal during its breaking sequence with respect to belt 12.

The cooperating structure which provides the combined ejection and terminal breaking operation, in accordance with the present invention, preferably follows the arrangement depicted in FIG. 3. This configuration is preferred as the angular displacement of the terminal itself during the breaking operation lessens the impact load on the perforations 12*a* of belt 12. Accordingly, the possibility of rupturing the severing belt 12 from sprocket 50 is minimized as the perpendicularly directed impact is accordingly reduced. However, it is anticipated that equally good results will obtain with the arrangement, such as that depicted in FIG. 4, as the perpendicular impact is nevertheless reduced as a function of the angular displacement of the crimped end of lead W by virtue of the movement of flipper 54'. That is, the momentum is exchanged over a greater range of belt 12 corresponding to the angular displacement of lead W. Thus, in any given arrangement, in accordance with the present invention, the possibility of rupturing the perforations which engage the sprocket wheel is substantially avoided as the otherwise direct impact exchanged at a substantial perpendicular point along the tape or belt is avoided.

In one constructed embodiment of the present invention, the linkage system between ram 42 and flipper 54 provided continuous movement of flipper 54 with respect to movement of ram 42. That is, no lost-motion connection was utilized. Instead, flipper 54 was positioned such that the continuous movement and overtravel thereof was accommodated by providing sufficient clearance therefor. Nevertheless, a lost-motion connection, which functions to move flipper 54 only during a predetermined portion of each cycle, can be utilized to suit a given application of the present invention, as desired.

Further, it will be appreciated by those skilled in the art that the function provided by flipper 54 can be provided by any other suitable means with equally good results. For example, an air or electromagnetically operated device such as an air spring or a solenoid can be used to move wire W, to break or pull the terminals from the belt. These alternative devices would by synchronized or suitably timed with the operating cycles of the terminal applicator in accordance with the principles of the present invention.

It will now be appreciated by those skilled in the art that the terminal applicator device 10, in accordance with the present invention, avoids the need for a translatable table to remove crimped terminals from a continuous belt as taught by the prior art. It should also be appreciated that the translatable table technique suffers from a substantial perpendicular impact load on the terminal belt as these tables are moved solely in a lateral direction while fixedly holding the crimped terminal relative to the moving table. Still further, the terminal breaking technique, in accordance with the present invention, also provides a dual function, namely that of ejecting the completed and severed lead from the crimping station or crimping area. It will be further appreciated by those skilled in the art that the translatable table technique requires an additional flipper means to accomplish this second function.

What has been taught, then, is a terminal applicator apparatus for terminals in strip form wherein the terminated lead is removed from the crimping station wherein the crimped terminal is broken away from, and thereby removed from, the belt. This invention further facilitates, notably, a fully automatic terminal applicator machine wherein the lead is axially inserted into the crimping barrel thereby accomodating closed barrel terminals.

The form of the inventions illustrated and described herein are but preferred embodiments of these teachings in the forms currently preferred for manufacture. They are shown as illustrations of the invention concepts, however, rather than by way of limitation, and it is pointed out that various modifications and alterations may be indulged within the scope of the appended claims.

What is claimed is:

1. Apparatus for crimping electrical terminal devices onto wires, said terminal devices being secured to a belt in side-by-side relationship with their axes extending laterally of said belt, said apparatus comprising:

a pair of cooperable crimping dies, said dies being movable relatively towards and away from each other to crimp a terminal device located therebetween onto one end of a wire;

belt feeding means fixedly mounted on one side of said dies, said belt feeding means being effective to guide and index said belt along a path extending past said dies on said one side thereof thereby to locate the leading uncrimped terminal on said belt between said dies;

first means on the other side of said dies for holding said wire substantially fixed at a point thereof which is spaced apart from said one end of said wire; and means located between said first means and said dies for moving said wire adjacent said one end relatively away from said dies and prior to completion of a subsequent indexing of said belt, to break a crimped terminal away from said belt.

2. The device as set forth in claim 1, wherein said means for moving said wire includes an ejector means movable in the direction of feeding of said belt after said dies have crimped a terminal on said wire and said dies have moved relatively away from each other.

3. The device as set forth in claim 2, wherein said first means is movable toward said dies for inserting said wire into a closed barrel of said terminal prior to crimping thereof.

4. A method for crimping terminal devices onto wire, said terminal devices being secured to a belt in side-by-side relationship with their axes extending laterally of the belt, said method comprising the steps of:

moving a pair of cooperating crimping dies relatively towards and away from each other to crimp a terminal device located therebetween onto one end of a wire;

guiding said belt along a fixed path extending past said dies and on one side thereof;

indexing said belt toward said dies and between successive crimping operations thereby to locate the next leading terminal on said belt between said dies;

holding said wire at a fixed point thereof which is spaced-apart from said one end; and moving at least the portion of said wire which is adjacent said one end relative to said fixed point, thereby to break the crimped terminal away from said belt.

5. The method according to claim 4, including the step of inserting said one end of said wire into the wire barrel of said leading terminal prior to the step of moving said dies to crimp said terminal.

6. The method according to claim 4, including the step of continuing to move said wire after said crimped terminal is broken away from said belt, thereby to eject terminated wires from the vicinity of said dies.

7. The method according to claim 4, including the step of rotating said crimped terminal while breaking said crimped terminal away from said belt, thereby to substantially reduce lateral terminal breaking forces on said belt.

8. The method according to claim 4, wherein said step of moving said wire incorporates a rigid member responsive to the movement of said dies away from each other for translation in the moving direction of said belt.

9. The method according to claim 8, wherein said rigid member is pivotally mounted to a stationary die base which fixedly carries one of said crimping dies and wherein said rigid member is angularly translated away from said crimping dies when said dies are moved relatively away from each other.

10. The apparatus according to claim 1, wherein the lateral spacing of said belt relative to said dies is fixed.

11. The apparatus according to claim 1, including wire guide means located between said first means and said means for moving said wire, for facilitating insertion of said wire into the barrel of a leading uncrimped terminal.

* * * * *